US005567055A

United States Patent [19]

Smith

[11] Patent Number: 5,567,055

[45] Date of Patent: Oct. 22, 1996

[54] SYSTEM FOR LASHING COMPONENTS TO MATERIAL

[75] Inventor: Patrick D. Smith, Golden, Colo.

[73] Assignee: Mountainsmith, Inc., Golden, Colo.

[21] Appl. No.: 291,588

[22] Filed: Aug. 15, 1994

[51] Int. Cl.[6] ..... B65D 30/22

[52] U.S. Cl. ..... 383/38; 190/102; 190/110; 224/240; 224/250; 383/40

[58] Field of Search ..... 190/102, 110; 224/240, 250; 387/38, 40

[56] References Cited

U.S. PATENT DOCUMENTS

| | | | |
|---|---|---|---|
| 3,813,017 | 5/1974 | Pimslevr | 224/240 |
| 4,029,243 | 6/1977 | Zerobnick et al. | 224/8 R |
| 4,079,767 | 3/1978 | Howard | 383/120 |
| 4,210,186 | 7/1980 | Belenson | 190/110 |
| 4,212,377 | 7/1980 | Weinreb | 190/110 |
| 4,260,004 | 4/1981 | Domke | 190/110 |
| 4,332,379 | 6/1982 | Bannister | 272/119 |
| 4,431,041 | 2/1984 | Leiserson | 190/102 |
| 4,449,654 | 5/1984 | Cappis | 224/148 |
| 4,463,789 | 8/1984 | Leiserson | 190/110 |
| 4,506,769 | 3/1985 | Franco et al. | 190/110 |
| 4,545,414 | 10/1985 | Baum | 150/52 J |
| 4,610,286 | 9/1986 | Cyr | 190/110 |
| 4,836,343 | 6/1989 | Arney | 190/102 |
| 4,911,271 | 3/1990 | Stanley | 190/102 |
| 4,923,105 | 5/1990 | Snyder | 224/240 |
| 5,025,965 | 6/1991 | Smith | 224/151 |
| 5,111,981 | 5/1992 | Allen | 224/250 |
| 5,356,004 | 10/1994 | Weinreb | 190/110 |

OTHER PUBLICATIONS

Reference "A", MountainSmith Product Brochure, title and author unknown.

Instruction Manual for MountainSmith Alpine Series Packs, author unknown, printed by MountainSmith.

*Primary Examiner*—Stephen P. Garbe

*Attorney, Agent, or Firm*—Robert G. Crouch; Chrisman, Bynum & Johnson, P.C.

[57] ABSTRACT

A lashing system for selectively attaching a component to a piece of material includes a pair of anchors or loops which are attached in a spaced part relationship to the piece of material. A pair of releasable connectors are provided on the component for engaging with the loops. The releasable connectors are positioned so that a fixed portion is mounted to the front side of the component and a moveable portion of the releasable connector is mounted at a terminal end to the back side of the component. The free end of the moveable portion of the releasable connector can be threaded through the loop to engage the loop and then can be connected to the matching surface of the releasable connector on the front side of the component. A lashing system is provided for the interior or exterior of a travel bag or backpack to lash containers, panels, or walls to the side panels thereof. A matrix of anchors is provided for the releasable connectors on the containers, panels or walls to engage therewith.

11 Claims, 4 Drawing Sheets

SYSTEM FOR LASHING COMPONENTS TO MATERIAL

SYSTEM FOR LASHING COMPONENTS TO MATERIAL

This invention relates to systems for lashing or affixing components to a piece of material such as a belt or an interior or exterior wall of a backpack or a piece of luggage, and in particular to improved lashing system for lashing any of a plurality of types of components to a piece of material with releasable connectors.

BACKGROUND OF THE INVENTION

A growing number of persons in this country and others are engaged in outdoor recreational pursuits. These includes hikers, runners, cyclists, skiers, climber, fishermen, hunters and the like. One characteristic common to many of the participants of these various activities is the need to carry equipment or supplies for use during the activity. This equipment or supplies may includes a squeeze bottle for water or other fluid for the participant, a pouch for carrying sunglasses or other types of eyeglasses, a pouch for a camera or lens, a pouch for carrying ammunition, a pouch for carrying fishing supplies and bait and the like. With each of these pieces of equipment or supplies, it is desirable to have them readily accessible to the participant.

Pockets defined in clothing worn by the participant have long served this need. However, as clothing for each of these outdoor activities has become more specialized, pockets have been eliminated in many instances. Typically, the participant in one of these outdoor activities carries a backpack with shoulder straps, a fannypack, a lumbar pack, or some other type of equipment bag. Unfortunately, by carrying equipment and supplies within such packs and bags, the participant must usually take the bag or pack off and unzip a pocket to gain access to the equipment. This is undesirable since the participant may desire quick and ready access to the equipment such as a waterbottle for use during the activity.

For this reason, specialized and dedicated pockets for equipment such as waterbottles have been designed for the external surfaces of backpacks, fannypacks, lumbar packs, and waistbelts. Alternatively, releasable pile and loop connectors have been utilized on waistbelts with the matching portion of the releasable connector on the piece of equipment such as a waterbottle. However, excess weight or other forces may cause the piece of equipment to become unintentionally detached from the waistbelt. Unfortunately, none of the approaches described above offer the flexibility to securely store any of several different components of equipment on a given location of an exterior surface of a belt, backpack or lumbar pack.

A somewhat related problem exists in the interior of backpacks, travel bags and luggage. Within such bags, it is often desirable to attach smaller containers or interior wails to the interior surfaces of the bag. Such arrangements are convenient to organize the interior of a bag and/or to segregate components of equipment therewithin as necessary. The closest attempt to solve this problem known to the applicant is done on a smaller scale in camera bags. Such camera bags may cover all of the interior surfaces of the bag with one of the mating surfaces of a releasable pile and loop connector. Vertically-oriented interior walls are then provided with mating surfaces for the releasable pile and loop connector so that they may be placed in any position as desired within the bag to create separate compartments. Unfortunately, in a larger-scale bag such a system will require a large mount of the releasable connector material. More importantly, it is undesirable to have large exposed portions of the releasable connector material tier snagging and interfering with clothing and equipment stored within the bags. Most importantly, the interior walls in camera bags provide only cushioning and compartmentalization.

SUMMARY OF THE INVENTION

Accordingly, it is an object of the present invention to provide a novel system for selectively attaching components of equipment to pieces of material, be they exterior surfaces of outdoor equipment bags or interior surface of travel bags. The walls can not support weight.

It is another object of this invention to provide a lashing system for components of equipment which provides a secure means of fastening the components to a piece of material.

It is a further object of this invention to provide a system for lashing components of equipment to a piece of material wherein any of several different types of components are selectively and easily attachable to the same portion of a piece of material.

It is still further an object of this invention to provide a lashing system for securely and conveniently attaching containers and/or interior walls to the interior surfaces of a bag.

It is still further an object of this invention to provide interior and exterior walls and panels for bags which are load-bearing.

Additional objects, advantages, and novel features of this invention shall be set forth in part in the description that follows, and in part will become apparent to those skilled in the an upon examination of the following description or may be learned by the practice of the invention. The objects and the advantages of the invention may be realized and attained by means of the instrumentalities and combinations particularly pointed out in the appended claims.

To achieve the foregoing and other objects and in accordance with the purposes of the present invention, as embodied and broadly described herein, the lashing system for selectively attaching a component to a piece of material includes a pair of anchors attached to the piece of material at a spaced apart relationship. The system also includes a pair of releasable connectors located on the component to be lashed to the piece of material. The pair of releasable connectors are attached to the component with a releasable connector on either of opposite sides of the component. One of the mating surfaces of each connector is attached to the front surface of the component while the matching mating surface is attached at a terminal end to the back side of the component. The free end of the matching surface may then be manipulated to engage with the anchor and then attached to the corresponding mating surface on the front of the component to securely lash the component to the piece of material.

Another aspect of the lashing system of the present invention includes the capability to selectively add a panel to a bag. A first and second anchor are attached to the bag in spaced apart relation from each other and the panel is connected thereto by a pair of releasable connectors attached to the panel. Each releasable connector includes a first mating surface attached to a side wall of a panel and another mating surface attached to a terminal end of the panel and having a opposite free end which may be threaded through the anchors and extended to attach to the other mating surface on the panel. These panels may be oriented vertically or horizontally and attached to the interior or exterior of the bag.

BRIEF DESCRIPTION OF THE DRAWINGS

The accompanying drawings, which are incorporated in and form a part of the specifications, illustrate the preferred embodiments of the present invention, and together with the descriptions serve to explain the principles of the invention. In the drawings.

DETAILED DESCRIPTION OF THE PREFERRED EMBODIMENT

Figure 1:
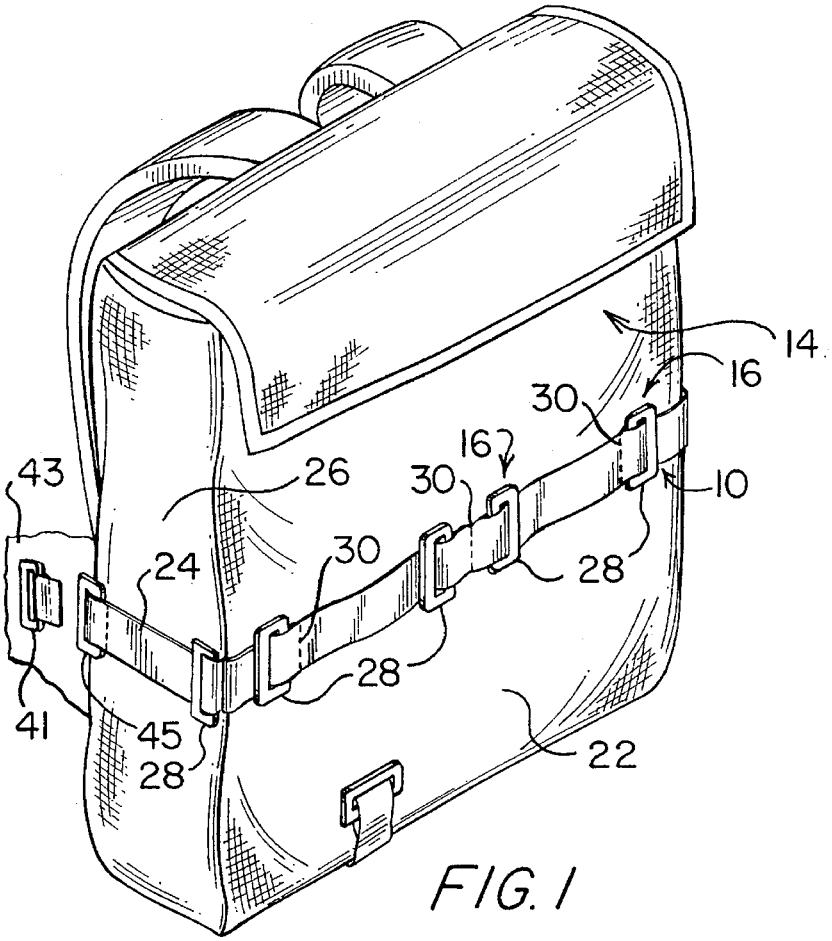
FIG. 1 is a perspective view of a lumbar pack showing the anchors of the lashing system of the present invention installed thereon.
Figure 3:
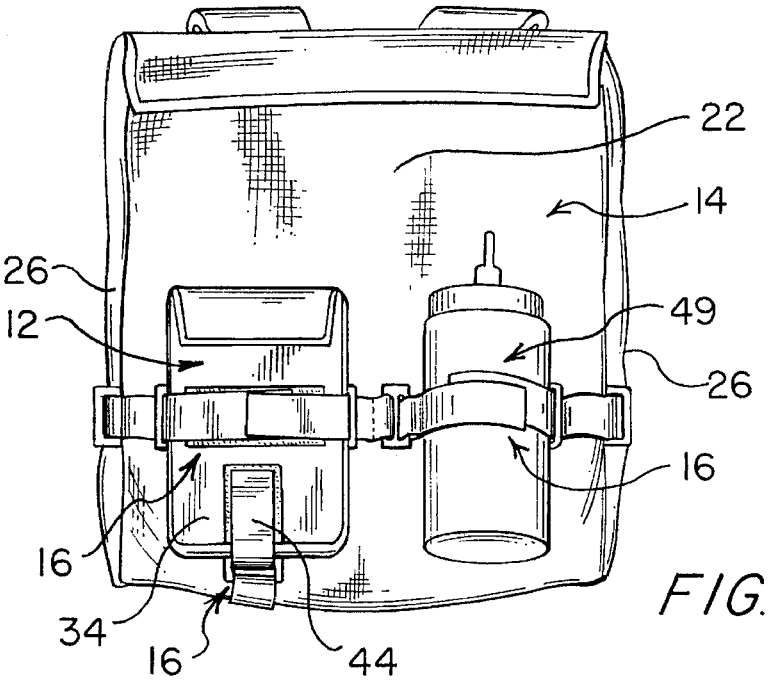
FIG. 3 is a front elevation view of a pair of components securely lashed to the anchors shown in FIG. 1.
Figure 2:
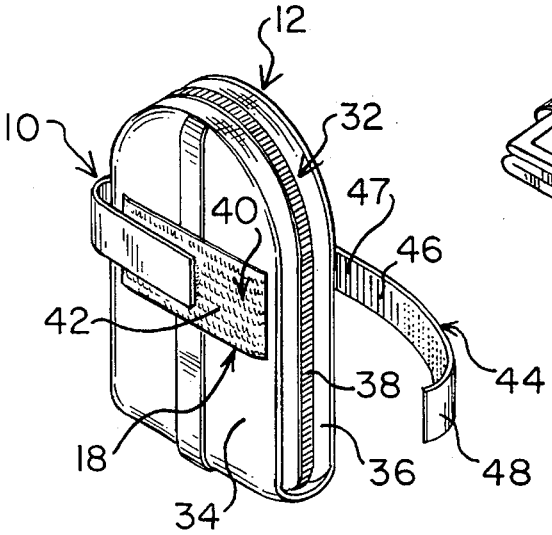
FIG. 2 is a perspective view of a component or carrying case such as for carrying sunglasses, the case having a pair of releasable connectors installed thereon for engaging with the anchors shown in FIG. 1.

The improved lashing system 10 of the present invention allows for the secure and interchangeable attachment of any of various components 12, as illustrated by a sunglasses carrying case 32, to the exterior surface of a lumbar pack 14, as shown in FIGS. 1–3. The pack 14 is provided with a plurality of anchors to which the component 12 may be lashed. The component 12 is provided with a pair of releasable connectors 18 mounted thereon for engaging with the anchors 16 on the pack 14.

The lumbar pack 14 includes a first fabric strap 20 stitched to a back surface 22 thereof. A second fabric strap 24 is stitched to a side panel 26 of the pack 14. The anchors 16 are retained on the pack 14 by the fabric straps 20 and 24. The anchors 16 are preferably in the form of plastic loops 28 held in a vertical orientation.

Each of the plastic loops 28 are held in place at a predetermined position along the fabric strap by stitching the fabric straps 20 and 24 to the back and side panels 22 and 26, respectively, on either side of each plastic loop 28. Thus, the stitching is located on either side of and adjacent to the plastic loops 28 of a pair so as to hold them in the predetermined position. The loops 28 are located in pairs for engagement with the component. Preferably, the plastic loops 28 of a pair are positioned at intervals of four and one eighth inches apart. Between the loops 28 of adjacent pairs there is a loop-to-loop spacing of three-quarters of an inch. The alternate spacing between plastic loops of four and one eighth inches and three quarter inches may continue across any given panel of the lumbar pack 14 or any other pack or belt as desired to receive a plurality of such components 12.

As can be seen in FIG. 2, the component 12 includes the carrying case 32 onto which the releasable connectors 18 are mounted. With the sunglasses case, the carrying case 32 features a front panel 34, a back panel (not shown), and a side panel 36 with a zipper 38 installed thereon. This side panel 36 is attached to both the front panel 34 and the back panel. A bottom panel (not shown) also is attached to the front panel 34, the side panel 36 and back panel. An elongated, fixed portion 40 of the releasable connector 18 extends horizontally across the width of the front panel 34 of the carrying case 32. The fixed portion 40 is preferably composed of pile material 42 of the releasable pile and loop connector 18. A flexible, moveable portion 44 of the releasable connector 18 includes the loop material 46 of the releasable connector 18. This movable portion 44 is stitched at a terminal end 47 thereof to the back panel of the case 32. A free end 48 of the movable portion is free to be extended across the side panel 36 to engage with the fixed portion 40 of the releasable connector 18. Importantly, the releasable connector spans from the back panel to the front panel of the component. The other releasable connector 18 is installed on the opposite side (right or left) of the carrying case 32 and has similar components (not all of which are shown).

The component 12 can be attached to the lumbar pack 14 by threading each of the movable portions 44 of the releasable connectors 18 through the corresponding spaced apart plastic loops 28 of any pair of loops. After the moveable portions 44 are threaded though the loops 28, the moveable portions 44 may be folded around the component 12 and engaged with the fixed portions 40 of the releasable connectors 18 so that the pile material 46 may engage with the loop material 42 of the releasable connector. As can be seen in FIG. 3, the sunglasses case component 12 can be lashed to a pair of the anchors 16 while a second component 49 such as a waterbottle can be lashed to another pair of anchors 16 which are also provided on the back panel 22 of the pack 14. The waterbottle 49 includes a pair of releasable connectors 18 which are installed thereon and function like the releasable connectors 18 described above for the sunglasses case component 12.

It can be appreciated that a plurality of different types of components (not shown) which have roughly the same shape and configuration and include a pair of releasable connectors 18 can be lashed to the lumbar pack 14 by engaging with the anchors 16 on the lumbar pack 14. Examples of other types of components which may be lashed to the lumbar pack 14 include an ammunition pouch, a rifle butt-carrying pouch, a mesh pouch, a camera pouch, a lens pouch, and a general purpose pouch (none of which are shown). Some of these components, for example the ammunition pouch, may require a third releasable connector 18, as shown in FIG. 3, a fixed portion 40 of which extends vertically on the front panel 34. The movable portion 44 is fixed at one end to the back panel and positioned to stretch across the bottom panel. This releasable connector 18 can then engage a third anchor which is spaced vertically below the first two anchors.

While not previously mentioned, most of the components 12 are flexible and compressible to some extent. Thus, the component can be compressed a desired amount depending upon the amount of overlap of the portions 40 and 44 of the releasable connector 18.

The lashing system 10 of the present invention may, of course, be utilized with a variety of different types of support members. Instead of the lumbar pack 14, a standard backpack with shoulder straps may include such a lashing system 10. Further, a fanny pack or a waistbelt may include such a system 10. Further, a side loop 45 (FIG. 1) on the pack 14 may be employed along with a loop 41 on a waistbelt 43 provided as a part of the pack. A component can be thus lashed between the belt and the pack to make the component accessible to the user while wearing the pack. The system 10 may also be employed for lashing components to most any support surface or material desired.

Figure 9:
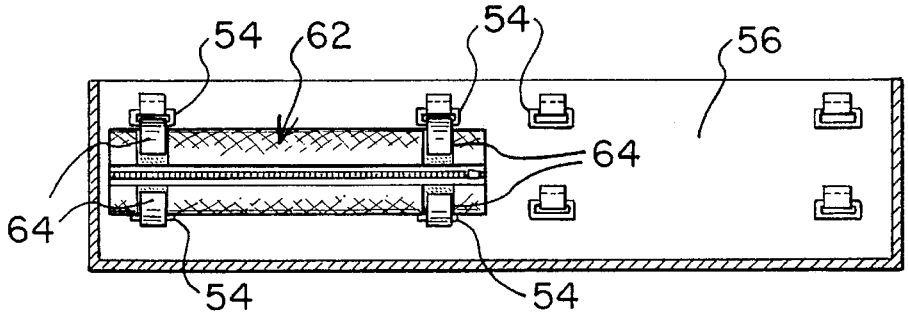
FIG. 9 is a from view of the interior surface of the travel bag of FIG. 6, showing the connection of the component to the travel bag.
Figure 4:
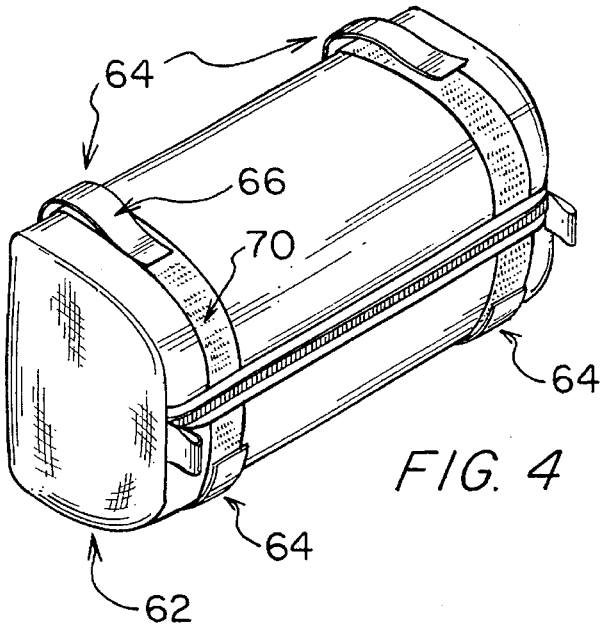
FIG. 4 is a perspective view of a relatively larger component such as a dop kit having two pairs of releasable connectors thereon for attachment to a larger travel bag.
Figure 6:
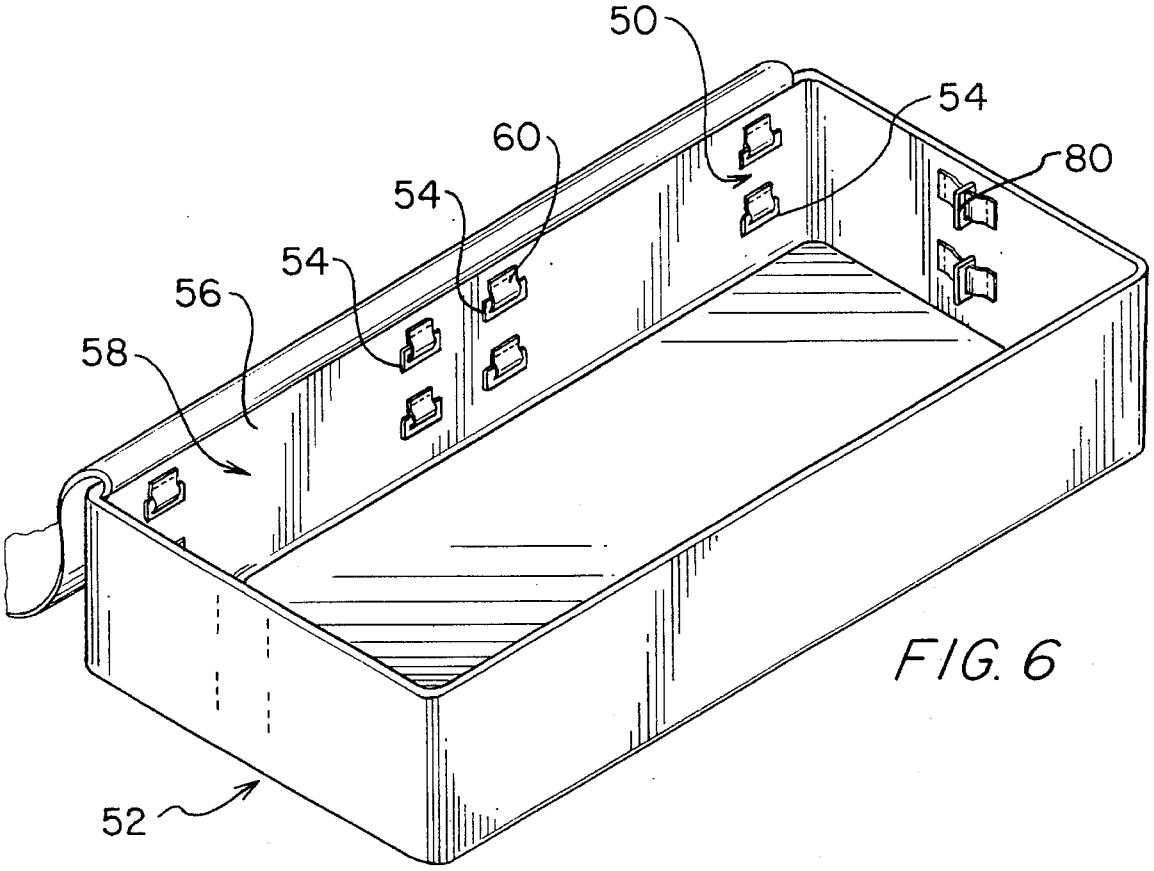
FIG. 6 is a perspective view of a travel bag or suitcase having a matrix of anchors of the lashing system of the present invention installed thereon and suitable for receiving the components shown in FIGS. 4 and 5.

A lashing system 50 is utilized to lash components to the interior surfaces of a backpack, travel bag 52, or suitcase. The travel bag 52, as shown in FIG. 6, includes a plurality of plastic loops 54 which serve as anchors. Each plastic loop is attached to an interior surface 56 of panels 58 of the travel bag 52 by a flexible loop of fabric 60 stitched to the panel 58. These plastic loops 54 are installed in a horizontally-oriented configuration with one plastic loop 54 being mounted at a vertically spaced apart distance of approximately four and one quarter inches. Horizontally spaced apart at a distance approximately eight and one half inches are another pair of vertically spaced apart plastic loops 54. Together, these four plastic loops 54 are arranged in a rectangular shape on the panel 58 of the travel bag. These four plastic loops 54 provide the mounting structure for a relatively large component 62 such as a dop kit (FIG. 4). The dop kit 62 is provided with two pairs of releasable connectors 64 which each have a fixed portion 66 having loop material thereon and a movable portion 70 having pile material thereon. The locations of the releasable connectors 64 on the dop kit component 62 correspond to the locations of the plastic loops 54 on the panel 58 of the travel bag 52 (FIG. 6,7, and 9).

Figure 5:
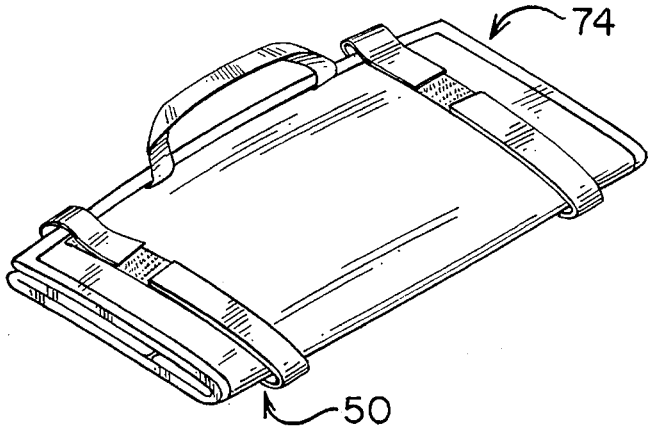
FIG. 5 is a perspective view of a relatively larger component such as a cosmetic bag having two pair of releasable connectors thereon for attachment to a larger travel bag.

Alternatively, as shown in FIG. 5, the component can be a cosmetics case 74. The cosmetics case 74 is provided with two pair of releasable connectors 64 located to correspond with the location of the plastic loops 54 on the panel 58 of the travel bag 52 as was the case with the dop kit component 62.

Figure 10:
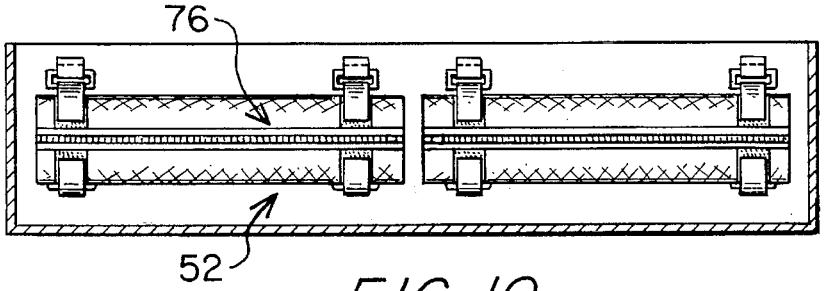
FIG. 10 is a from view of the interior surface of the travel bag of FIG. 6, showing the connection of a relatively larger component to the travel bag.
Figure 8:
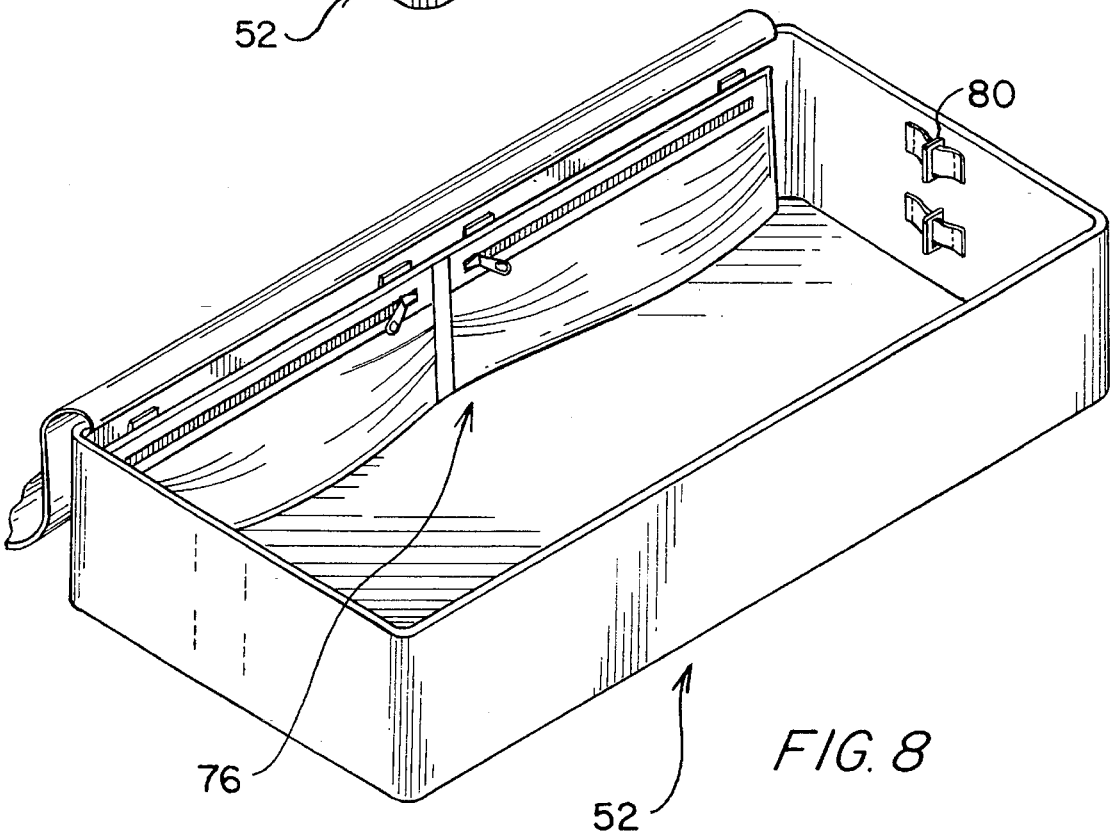
FIG. 8 is a perspective view of the travel bag shown in FIG. 6 with an extended bag having four pairs of releasable connectors for attachment across the entire width of the rear panel of the bag.

Similarly, a component 76 which is approximately twice as long as the cosmetics case 74 and dop kit 62 may be provided with four pair of releasable connectors 64, as shown in FIG. 8 and 10. Such a component 76 will extend along the entire width of the panel 58 to engage with a similarly situated set of four pair of plastic loop 54.

Figure 7:
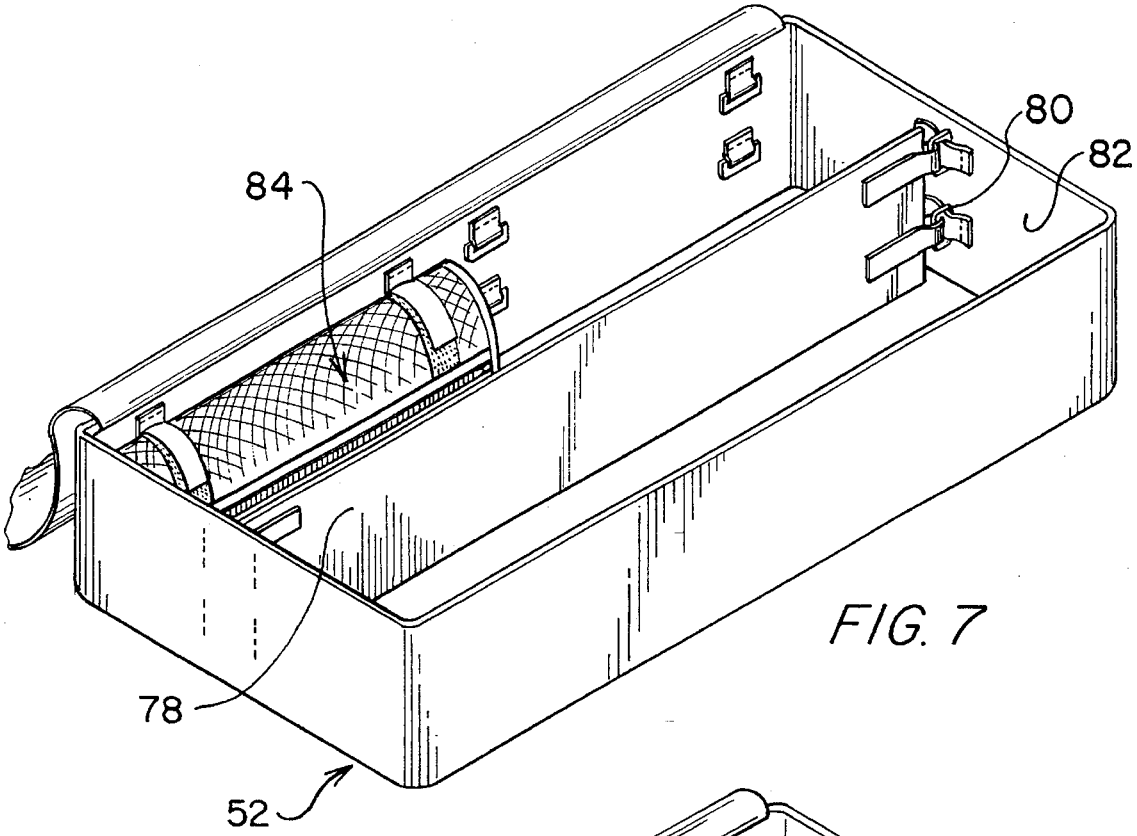
FIG. 7 is a perspective view of the travel bag shown in FIG. 6 with a component, such as a mesh bag, shown installed on a rear panel and a vertically-oriented interior wail shown mounted to the side panels of the bag.

FIG. 7 illustrates a vertical interior wall 78 installed within the travel bag 52. The vertical interior wall 78 is provided with releasable connectors 64 which engage with a pair of vertically-oriented plastic loops 80 provided on a side panel 82 of the travel bag 52. The movable portion 70 of the releasable connector 18 may be attached to the side seam (not shown) to increase the strength and profile of the wail. It is also possible to provide a horizontal wall 96 as desired. In the case of horizontal walls 96, the loops will be oriented horizontally. The wall 96 can also be used as a panel within the interior of a backpack 90 to compress a sleeping bag in a bottom end thereof, for example. A walls 94 may also be provided as a panels for the exterior of the backpack 90 for strapping and carrying fire wood or game on the exterior of the backpack. A matrix of the loops 28, 54, and 80 will be provided across the interior and exterior of bags and packs for engagement by such walls, panels, and components.

As is also shown in FIG. 7, a mesh component 84 can be used to carry wet objects such as a swim suit. The mesh component 84 has two pair of releasable connectors 64 for lashing to the previously discussed arrangement of four plastic loops 54 on the panel 58 of the travel bag.

The foregoing is considered illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to as falling within the scope of the invention as defined by the claims which follow.

The invention claimed is:

1. A lashing system for selectively attaching a component to a piece of material, the system comprising:

a piece of material;

a first pair of anchors attached to the piece of material at a spaced apart relationship, the two anchors of the first pair being separated from each other by a predetermined distance;

a component removably and selectively attached to the piece of material, the component having a front side, a back side, a right side, and a left side, the component having a first pair of releasable connectors attached to the component, each releasable connector having two mating surfaces, with one of the mating surfaces being attached to the front side of the component, and the other of the mating surfaces being attached to an elongated strap, a terminal end of the strap being attached to the component at a location on the back side of the component and the strap having an opposite free end, wherein one of the first pair of releasable connectors is located on the left side of the component and the other of the first pair of releasable connectors is located on the right side of the component, the distance between the attachment locations of the terminal ends being approximately equal to the predetermined distance between the two anchors of the first pair, wherein the strap of each of the first pair of releasable connectors is threaded around the corresponding one of the first pair of anchors with the free end of each strap threaded around the corresponding one of the first pair of anchors and folded back over the front side of the component to form a loop of material from the folded-over strap to encircle the anchor and allow the other mating surface on the strap to engage with the mating surface on the front side of the component, to lightly lash and anchor the component to the piece of material; and a second pair of anchors attached to the material at a spaced apart relationship, the two anchors of the second pair being separated from each other by a distance approximately equal to the predetermined distance between the two anchors of the first pair, the second pair of anchors being separated from the first pair of anchors by a second predetermined distance;

wherein the component further includes a second pair of releasable connectors attached to the component, the second pair of releasable connectors being separated from the first pair of releasable connectors by a distance approximately equal to the second predetermined distance, each releasable connector having two mating surfaces, with one of the mating surfaces being attached to the front side of the component, and the other of the mating surfaces being attached to an elongated strap, a terminal end of the strap being attached to the component at a location on the back side of the component and the strap having an opposite free end, wherein one of the second pair of releasable connectors is located on the left side of the component and the other of the second pair of releasable connectors is located on the right side of the component, the distance between the attachment locations of the terminal ends being approximately equal to the distance between the two anchors of the second pair, wherein the strap of each of the second pair of releasable connectors is threaded around the corresponding one of the second pair of anchors with the free end of each strap threaded around the corresponding one of the second pair of anchors and folded back over the front side of the component to form a loop of material from the folded-over strap, to encircle the anchor and allow the other mating surface on the stop to engage with the mating surface on the front side of the component, to tightly lash and anchor the component to the piece of material.

2. A lashing system as defined in claim 1, further including:

a third pair of anchors attached to the material at a spaced apart relationship, the two anchors of the third pair being separated from each other by a distance approximately equal to the predetermined distance between the two anchors of the first pair;

a fourth pair of anchors attached to the material at a spaced apart relationship, the two anchors of the fourth pair being separated from each other by a distance approximately equal to the predetermined distance between the two anchors of the first pair, the second pair and the fourth pair of anchors being located on a line which is parallel to a line on which the first pair and the third pair of anchors are located;

wherein the component further includes a third pair of releasable connectors attached to the component, each releasable connector having two mating surfaces, with one of the mating surfaces being attached to the front side of the component, and the other of the mating surfaces being attached to an elongated strap, a terminal end of the strap being attached to the component at a location on the back side of the component and the strap having an opposite free end, wherein one of the third pair of releasable connectors is located on the left side of the component and the other of the third pair of releasable connectors is located on the right side of the component, the distance between the attachment locations of the terminal ends being approximately equal to the distance between the two anchors of the third pair, wherein the strap of each of the third pair of releasable connectors is threaded around the corresponding one of the third pair of anchors with the free end of each strap threaded around the corresponding one of the third pair of anchors and folded back over the front side of the component to form a loop of material from the folded-over strap, to encircle the anchor and allow the other mating surface on the strap to engage with the mating surface on the front side of the component, to tightly lash and anchor the component to the piece of material; and wherein the component further includes a fourth pair of releasable connectors attached to the component, the fourth pair of releasable connectors being separated from the third pair of releasable connectors by a distance approximately equal to the second predetermined distance, the second pair and the fourth pair of releasable connectors being located on a line which is parallel to a line on which the first pair and the second pair of releasable connectors are located, each releasable connector having two mating surfaces, with one of the mating surfaces being attached to the front side of the component, and the other of the mating surfaces being attached to an elongated strap, a terminal end of strap being attached to the component at a location on the back side of the component and the strap having an opposite free end, wherein one of the fourth pair of releasable connectors is located on the left side of the component and the other of the fourth pair of releasable connectors is located on the right side of the component, the distance between the attachment locations of the terminal ends beings approximately equal to the distance between the two anchors of the fourth pair, wherein the strap of each of the fourth pair of releasable connectors is threaded around the corresponding one of the fourth pair of anchors with the free end of each strap threaded around the corresponding one of the fourth pair of anchors and folded back over the front side of the component to form a loop of material from the folded-over strap, to encircle the anchor and allow the other mating surface on the strap to engage with the mating surface on the front side of the component, to tightly lash and anchor the component to the piece of material.

3. A lashing system for selectively attaching a component to a piece of material, the system comprising;

a piece of material;

a pair of anchors attached to the piece of material at a spaced apart relationship, the two anchors of the pair being separated from each other by a predetermined distance; and a first component removably and selectively attached to the piece of material, the first component having a front side, a back side, a right side, and a left side, the first component having a pair of releasable connectors attached to the first component, each releasable connector having two mating surfaces, with one of the mating surfaces being attached to the front side of the first component, and the other of the mating surfaces being attached to an elongated strap, a terminal end of the strap being attached to the first component at a location on the back side of the first component and the strap having an opposite free end, wherein one of the pair of releasable connectors is located on the left side of the first component and the other of the pair of releasable connectors is located on the right side of the first component, the distance between the attachment locations of the terminal ends being approximately equal to the predetermined distance between the two anchors of the pair, wherein the strap of each of the pair of releasable connectors is threaded around the corresponding one of the pair of anchors with the free end of each strap threaded around the corresponding one of the pair of anchors and folded back over the front side of the first component to form a loop of material from the folded-over strap to encircle the anchor and allow the other mating surface on the strap to engage with the mating surface on the front side, to tightly lash and anchor the first component to the piece of material;

wherein a second component can be lashed to the piece of material, further including;

a second pair of anchors attached to the material at a spaced apart relationship and located on a line common to a line through the first pair of anchors wherein distance between the anchors of the first pair is substantially equal to the distance between the anchors of the second pair so that the first component or the second component could selectively be tightly lashed and anchored to the piece of material via the second pair of anchors, further wherein said substantially equal distance is substantially greater than the distance between the first pair of anchors and the second pair of anchors.

4. A lashing system as defined in claim 3 wherein the distance between the anchors of the first pair is approximately four and one eighth inches.

5. A lashing system as defined in claim 3 wherein the distance between the anchors of the first pair is in the range of three to six inches.

6. A lashing system as defined in claim 5 wherein the distance between the first pair of anchors and the second pair of anchors is in the range of one half to one inch.

7. A lashing system as defined in claim 6 wherein the distance between the first pair of anchors and the second pair of anchors is approximately three quarters of an inch.

8. A lashing system for selectively attaching a component to a piece of material, the system comprising:

a piece of material;

a pair of anchors attached to the piece of material at a spaced apart relationship, the two anchors of the pair being separated from each other by a predetermined distance; and a component removably and selectively attached to the piece of material, the component having a front side, a back side, a right side, and a left side, the component having a pair of releasable connectors attached to the component, each releasable connector having two mating surfaces, with one of the mating surfaces being attached to the front side of the component, and the other of the mating surfaces being attached to and elongated strap, a terminal end of the strap being attached to the component at location on the back side of the component and the strap having an opposite free end, wherein one of the pair of releasable connectors is located on the left side of the component and the other of the pair of releasable connectors is located on the right side of the component, the distance between the attachment locations of the terminal ends being approximately equal to the predetermined distance between the two anchors of the pair, wherein the strap of each of the pair of releasable connectors is threaded around the corresponding one of the pair of anchors with the free end of each strap threaded around the corresponding one of the pair of anchors and folded back over the front side of the component to form a loop of material from the folded-over strap to encircle the anchor and allow the other mating surface on the strap to engage with the mating surface on the front side, to tightly lash and anchor the component to piece of material;

wherein each of the loops is mounted in a substantially vertical orientation with an axis passing perpendicularly through an opening defined in the loop, the axis being in a substantially horizontal orientation;

wherein the component has a bottom side, the system further including;

a third anchor defining a loop attached to the piece of material at a spaced apart relationship from the pair of anchors and mounted in a substantially horizontal orientation with a vertical axis passing perpendicularly through an opening defined in the loop, the vertical axis intersecting said horizontal axis between said pair of anchors; and wherein the component further includes a third releasable connector attached along the bottom side of the component, each releasable connector having two mating surfaces, with one of the mating surfaces being attached to the front side of the component, and the other of the mating surfaces being attached to an elongated strap, a terminal end of the strap being attached to the component at a location on the back side of the component and strap having an opposite free end, the free end of the strap being threaded around the third anchor and folded back over the front side of the component to form a loop of material from the folded-over strap, to encircle the anchor and allow the other mating surface on the strap to engage with the mating surface on the front side, to tightly lash and anchor the component to the piece of material.

9. A lashing system for selectively adding a panel to a bag, comprising:

a bag;

a first anchor attached to the bag;

a second anchor attached to the bag in spaced apart relation from the first anchor; and a panel removably and selectively attached to the bag, the panel having a pair of releasable connectors attached to the panel, each releasable connector having two mating surfaces, with one of the matin surfaces being attached to the panel, and the other of the mating surfaces being attached to an elongated strap, a terminal end of the strap being attached to the panel and having an opposite free end, wherein one of the pair of releasable connectors is located on one end of the panel and the other of the pair of releasable connectors is located on the opposite end of the panel, wherein the strap of each of the pair of releasable connectors is threaded around the corresponding one of the pair of anchors with the free end of each strap threaded around the corresponding one of the pair of anchors and folded back over the panel to form a loop of material from the folded-over strap to encircle the anchor and allow the other mating surface on the strap to engage with the mating surface on the panel, to tightly lash and anchor the panel to the bag.

10. A lashing system as defined in claim 9 wherein the panel is oriented vertically.

11. A lashing system as defined in claim 9 wherein the panel attaches to the interior of the bag.

* * * * *